United States Patent [19]

Sanderford, Jr. et al.

[11] Patent Number: 4,604,607

[45] Date of Patent: Aug. 5, 1986

[54] SECURITY DEVICE SIMULATING CURRENCY PACK OR THE LIKE

[75] Inventors: Hugh B. Sanderford, Jr.; John R. Souvestre, both of Metairie, La.

[73] Assignee: Protection Products Corporation, New Orleans, La.

[21] Appl. No.: 107,527

[22] Filed: Dec. 27, 1979

[51] Int. Cl.[4] ..... G08B 1/08

[52] U.S. Cl. ..... 340/539; 340/534; 340/568; 340/574; 340/356; 109/31; 109/36; 109/38

[58] Field of Search ..... 340/539, 534, 536, 568, 340/571–574, 345, 356; 375/82, 99, 102; 455/63, 67, 68; 109/31, 36, 38, 33

[56] References Cited

U.S. PATENT DOCUMENTS

| | | | |
|---|---|---|---|
| 3,564,525 | 2/1971 | Robeson et al. | 340/539 |
| 3,618,059 | 11/1971 | Allen | 340/539 |
| 3,848,231 | 11/1974 | Wootton | 340/539 |
| 4,021,807 | 5/1977 | Culpepper et al. | 340/539 |
| 4,032,848 | 6/1977 | Shaughnessy | 340/539 |

*Primary Examiner*—Donnie L. Crosland
*Attorney, Agent, or Firm*—Guy W. Shoup

[57] ABSTRACT

A security device simulating a currency pack or the like to foil robbery includes a receiver unit for receiving a local carrier signal generated locally at the exits of the bank. The carrier signal includes information in a predetermined binary code and the security device includes logic elements producing a signal activating a tear gas charge or the like when a signal is received carrying information in the predetermined code.

16 Claims, 4 Drawing Figures

SECURITY DEVICE SIMULATING CURRENCY PACK OR THE LIKE

The present invention relates to security devices for foiling robberies and, more particularly, to such devices simulating a currency pack or the like and adapted to sound an alarm or release an agent such as tear gas upon being passed through a local electromagnetic field guarding a secured area.

Security devices of this general type are known and typically include a charge of tear gas or similar agent set off by a receiver responsive to local signals transmitted at the exit of a secured area. These security devices are often disguised as currency packs so one may be included among the currency packs demanded by a bank robber for discouraging his retaining the packs after leaving the bank.

Such security devices can, of course, be quite disconcerting if inadvertently caused to activate within the bank, or during storage or transport. Such devices, however, often respond to the mere presence of signals of particular frequency and thus may be activated inadvertently by spurious signals from such sources as electronic typewriters, computer CRT displays, communications equipment, other types of security devices or even power lines. Such security devices also are often susceptible to being activated inadvertently during maintenance and, since the devices are rarely acutally used, it is also quite desirable to provide a simple manner for testing the device periodically to assure it has sufficient power remaining in its batteries to function when needed.

It is, therefore, a principal object of the present invention to provide a security device of the type described above which is responsive only to predetermined electromagnetic signals unlikely to be present in background noise.

A further object of the present invention is to provide such a device which may be disarmed easily to facilitate maintenance, transportation and storage.

An additional object of the present invention is to provide such a security device which may be tested readily.

A security device provided according to the present invention is adapted to be secreted within a package resembling a currency pack or the like and includes at least one means such as a tear gas charge or a sonic emitter for foiling unauthorized removal of the package passed an electromagnetic carrier signal generated locally. The carrier signal carries information in a predetermined binary code and the security device includes circuits responsive to said carrier signal for activating the means such as a tear gas charge or sonic emitter only if the predetermined binary code is received properly. Preferably, the tear gas charge on the like is activated a short time after the properly coded signal is received to assure the robber has left the secured area before he becomes aware of the phoney currency pack.

The binary code selected includes a predetermined number of streams of serial data bits. Each stream is of a predetermined duration with a predetermined number of data bits, and the streams are separated from one another by predetermined time intervals. The binary code can thus be validated with few logic components, particularly if eight streams of eight data bits each are used.

In preferred form, the logic components include a counter recording each stream of received data bits and generating a signal activating the tear gas charge or similar device upon recording eight correct streams. A stream-valid circuit is connected to the counter for resetting it each time the stream being received fails to contain eight data bits during a time period normally set to be a little longer than the predetermined duration of a valid stream of data bits, and an interval-valid circuit is also connected to the counter for resetting it whenever the time period between successive streams is too long. The stream-valid circuit and interval-valid circuit may include a common NAND circuit having its output connected to the reset port of the counter. The stream-valid means could then include a low count means connected to one input of the common NAND circuit for making that input logically low whenever less than eight data bits are received during the duration set in the stream-valid means, and the interval-valid circuit could include a timer having that output which is adapted to go logically low after expiration of the interval set between successive streams being connected to the other input of the common NAND circuit. In this way, the common NAND circuit will output a logically high signal to reset the counter whenever the interval between successive streams is too long, or less than eight data bits are received during the duration set in the stream-valid means. Further, the interval-valid circuit may include a high count circuit connected to the reset port of the timer for resetting it whenever more than the eight data bits are received during the set duration.

In such case, the high count circuit and the low count circuit could include a common bit counter receiving each data bit and adapted to be reset upon the beginning of each stream thereof. The low count circuit could thus include a NAND circuit having its output connected to the common NAND circuit noted above with one input adapted to go logically high after expiration of the duration set in the stream-valid means and the other input connected to several outputs of the bit counter. These several outputs are selected so that a logically high signal will appear in at least any one thereof for any count below eight and the NAND circuit will thus output a logically low signal to the common NAND circuit whenever the count of the data bits during the set duration is below eight. The high count circuit could include another NAND circuit having its output connected to the reset port of the timer with one input receiving the data bits and the other input connected to that output of the bit counter receiving a logically high signal when the count of the bits reaches eight. In this way, this latter NAND circuit will reset the timer whenever more than eight data bits are received during the set duration.

In one embodiment of the present invention, the means foiling unauthorized removal of the package is a pyrotechnic device adapted to liberate tear gas upon activation. The pyrotechnic device may also be designed to liberate a staining agent to render any currency packs near by non-negotiable and indentifiable. The foiling means may also include a sonic emitter to signal an alarm and, preferably, the sonic emitter is set to go off before the pyrotechnic charge to give a warning if the device should be adtivated inadvertently.

Additionally, means may be provided for inhibiting activation of the device and these means preferably include a switch adapted to be opened by inserting a plug into a test jack. This plug may also include a display activated upon proper operation of the receiving circuitry, or merely upon the presence of sufficient power to activate the receiving circuitry properly.

The foregoing and other objects, features and advantages of the present invention will be further apparant from the following detailed description taken together with the accompanying drawings, in which.

Figure 3A:
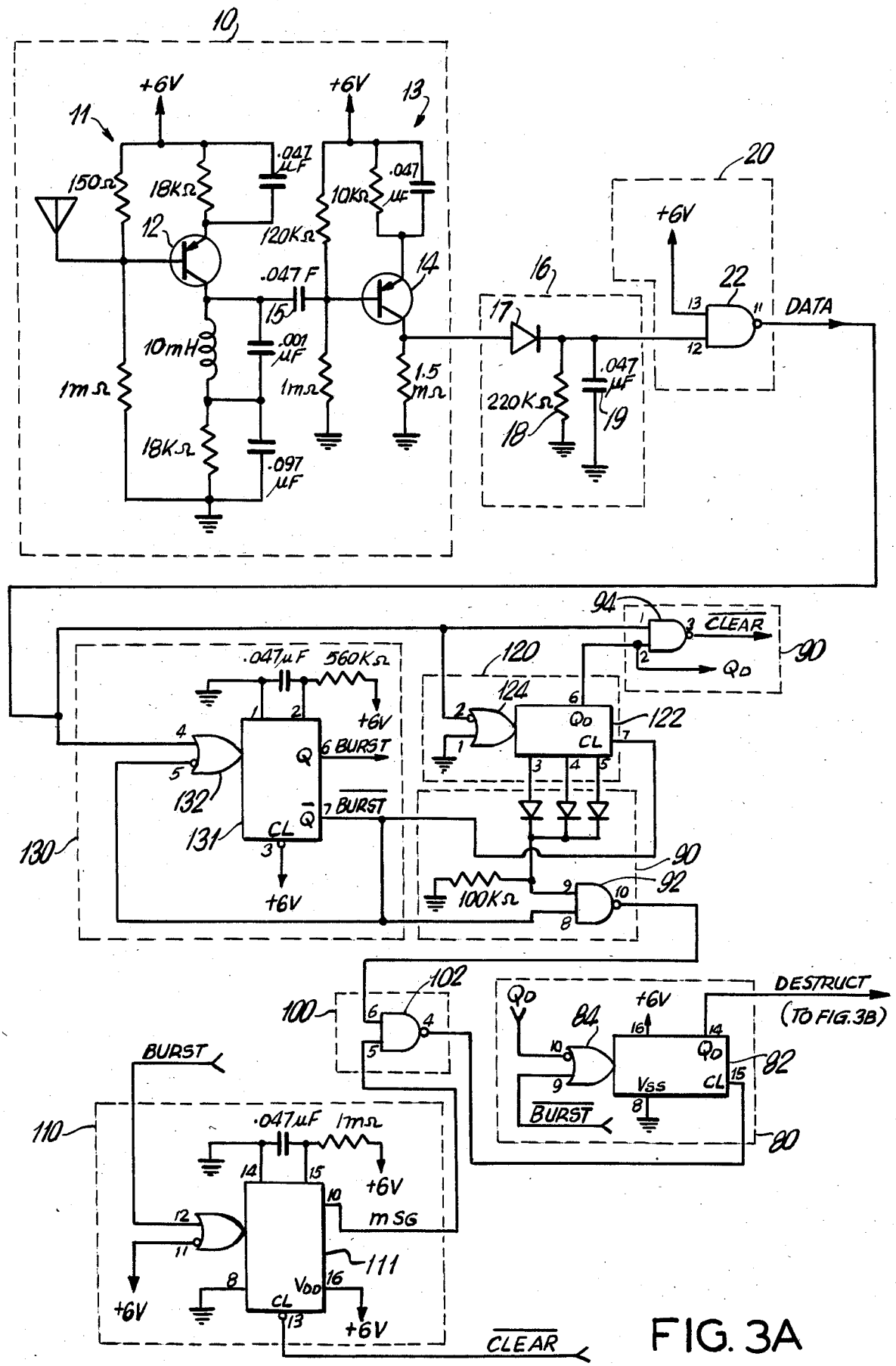
Figure 3B:
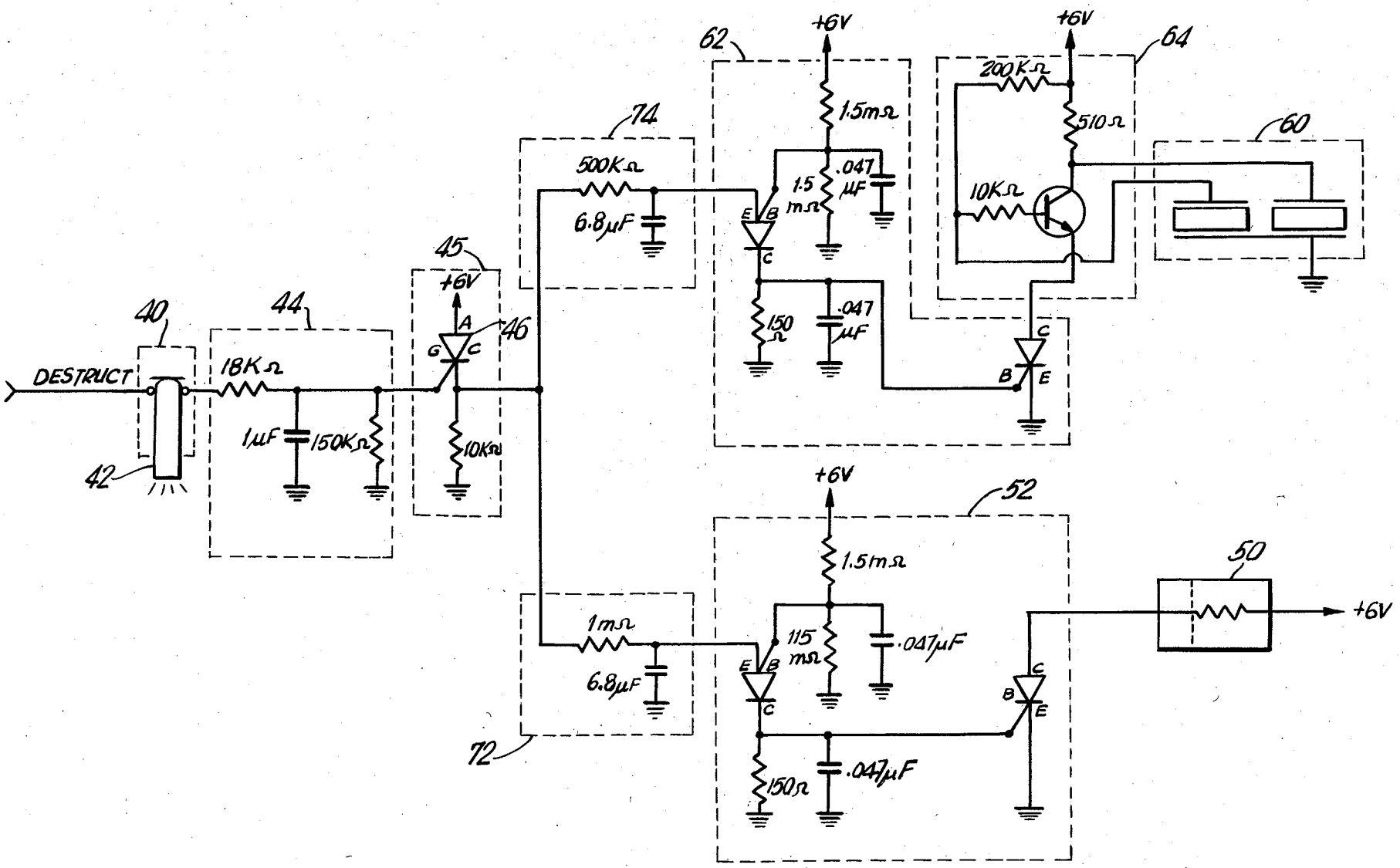

FIGS. 3A and 3B taken together illustrate a schematic diagram of the circuitry of an embodiment of the present invention.

A security device according to the present invention may be packaged to simulate any valuable commodity subject to robbery. In its most common form, the present invention would be packaged to simulate a currency pack and preferably would have a few real bank notes exposed on its exterior and bound to the device by a currency band. Such simulated currency packs are known and the important features of the present invention distinguishing it from the known art are described below.

Figure 1:
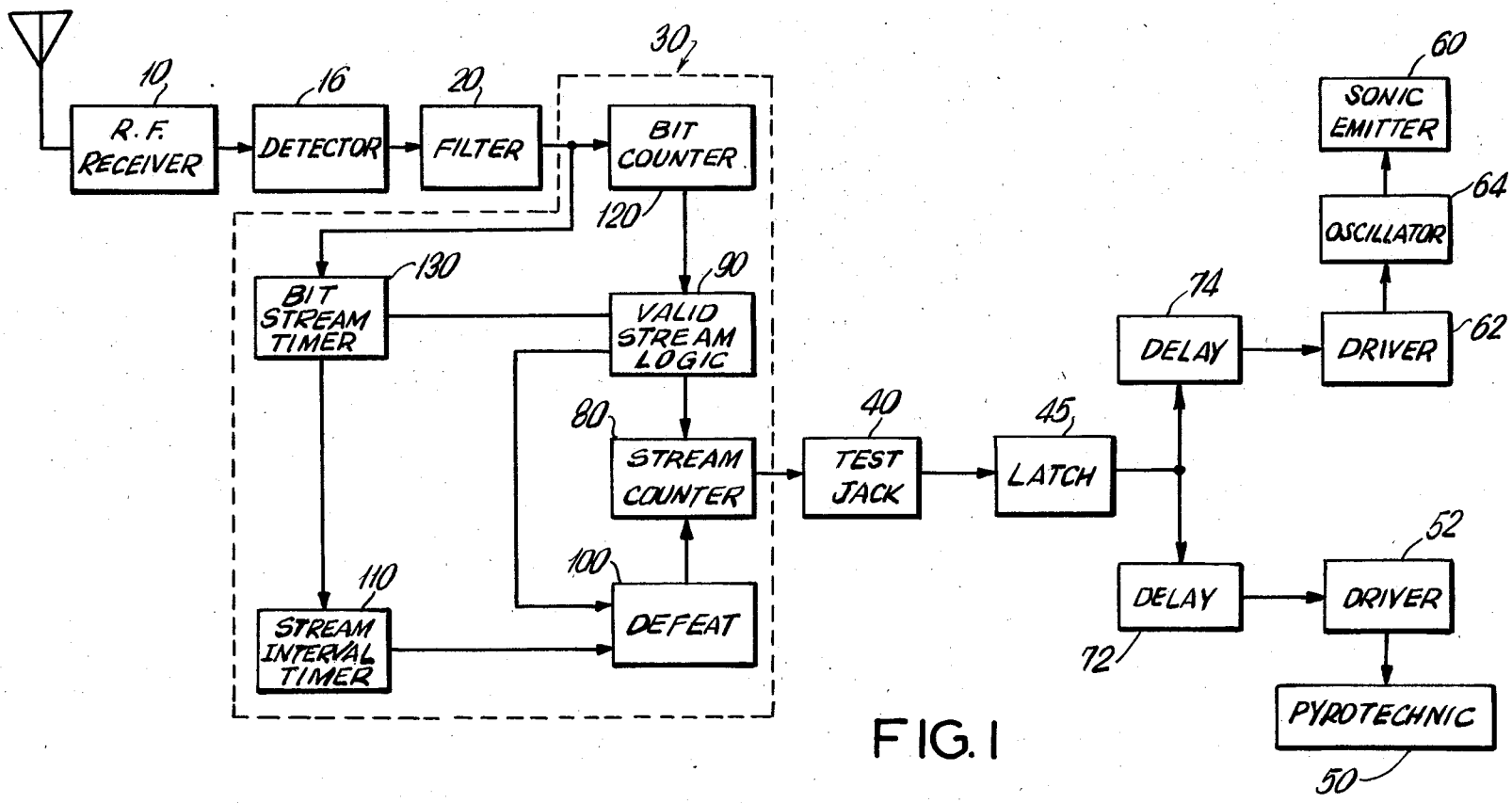
FIG. 1 is a block diagram illustrating generally the circuitry of an embodiment of the present invention.
Figure 2:
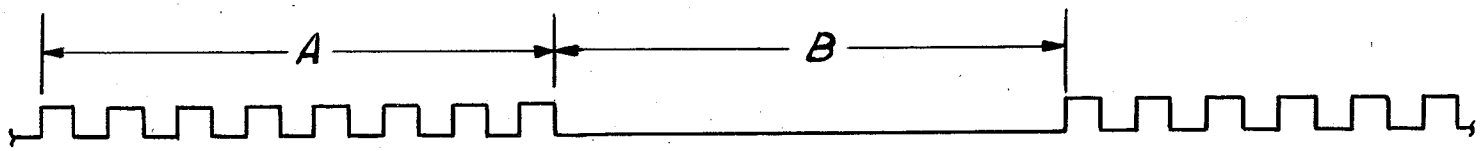
FIG. 2 illustrates the binary code used in the illustrated embodiment.

As illustrated generally in FIG. 1, the circuitry of the present invention includes a receiver unit 10 tuned to a predetermined carrier signal which is propagated locally about the exit of the secured area. Preferably, the carrier signal is propagated from a loop or inverted U-shaped antenna fitted in a doorway, as is known, and carries information in a predetermined binary code which may be impressed on the carrier signal by known on-off keying techniques. The carrier signal is preferably of a relatively low frequency, such as 50 kHz, and the coded message preferably includes a plurality of streams of data bits. The streams are each of a common duration and include eight data bits apeice. Further, the streams are separated from one another by a set interval. As shown in FIG. 2, the information carried by the carrier signal may include streams A having eight data bits and separated by the interval B equal in time to the duration set for each stream. It has been found that eight such streams provide a secure code which can be validated by a minimum number of logic components in a convenient manner.

Signals of 50 kHz are selected and amplified by the receiver unit 10 and passed to a detector 16 extracting information carried by the received signals. The extracted information is sent to a filter circuit 20 which eliminates noise and otherwise conditions the information for processing by logic ciruitry 30.

The logic circuitry 30 evaluates the information extracted from the received signal and produces an output signal if the received information conforms to the predetermined binary code of the signal propagated at the exits of the secured area. Should a signal near 50 kHz be received by the receiver unit 10 which does not carry information conforming to this binary code, the logic circuitry 30 fails to produce any output signal. In this way, spurious signals having a frequency in the range of 50 kHz from any number of background noise sources will not be able to activate the security device.

The output from the logic circuitry 30 is sent to a latch 45 through a test jack 40 to be described more fully below. The latch may send an activating signal to one or more devices to be activated by carrying the security device passed the carrier signal guarding the secured area. In a preferred form of the present invention, the latch will activate both a pyrotechnic device 50 through a driver 52 and a sonic emitter 60 through driver 62 and oscillator 64.

The pyrotechnic device operates to release a charge of tear gas and also an agent able to stain both the robber and other currency packs to render the robber and these packs identifiable and reduce the robber's ability to negotiate the currency packs. The pyrotechnic device and sonic emitter are activated through respective delay circuits 72 and 74 to assure they will not function until after the robber has left the bank. Preferably, the delay for the pyrotechnic device is longer than that for the sonic emitter so that the latter will sound first to give advance warning of an inadvertent activation of the pyrotechnic device.

The test jack 40 forms an important feature of the present invention and includes a normally closed switch situated interiorly of the package. This switch may be opened by a plug insertable through an opening in the package, which opening preferably is concealed beneath the currency band. The test jack may be used advantageously for several purposes, one of which is to disarm the security device for maintenance, transportation or storage by simply inserting a dummy plug into the test jack. In this way, any output signals from the logic circuitry 30 are prevented from activating the pyrotechnic device or sonic alarm. Additionally, the test jack could be used to test operation of the security device, or to determine if the batteries thereof can supply adaquate current to the receiver unit 10. In such cases, a plug having an appropriate display made up of light emitting diodes or liquid crystals may be inserted in the test jack. The security device may then be carried passed a carrier signal carrying the proper binary code to activate the display without the danger of activating the pyrotechnic device or sonic emitter.

The output signal from the logic circuitry 30 is produced by the output of the stream counter 80. Stream counter 80 is advanced one count each time a stream of data bits is received from the filter circuit 20. The stream counter 80 produces its output after eight streams are recorded and is reset by valid-stream logic 90 whenever the number of databits received by a stream having a duration set by the logic is not eight. The counter 80 is also reset through a defeat circuit 100 whenever the interval between successive streams is too long as determined by the stream-interval timer 110. In this way, the stream counter 80 will produce its output only after eight streams correctly conforming to the binary code are received. The data bits supplied by the filter circuit 20 are initially fed to a bit counter 120 supplying information on the number of bits of each stream to the valid-stream logic 90. The data bits are also sent to the bit stream timer 130 which provides a timing signal corresponding to the predetermined duration set for the streams upon receiving a data bit from filter circuit 20.

The logic circuitry 30, as well as other important circuits of FIG. 1, are described more completely in FIGS. 3A and 3B which illustrate a schematic diagram for a preferred embodiment of the present invention.

As shown in FIG. 3A, receiver unit 10 includes a first stage 11 having a bipolar transistor 12 and a second state 13 including bipolar transistor 14. The second stage 13 is coupled to the first stage 11 by capacitor 15. The first stage 11 is tuned to receive signals having a frequency of 50 kHz and these signals are further amplified by the second stage 13. The receiver unit 10 is biased nearly off and is designed to draw 40 μA of ambient current from a 6 volt supply. Signals received by the receiver unit 10 are sent to detector 16 consisting of a diode 17 and an integrator formed by the resistor 18 and capacitor 19. The information extracted by the detector 16 is condition by the filtering circuit 20 which includes a schmitt trigger 22 serving to square up the extracted information and eliminate noise to provide a DATA signal suitable for the logic circuitry 30.

The DATA signal is composed of data bits and is sent to the bit counter 120 and the bit stream timer 130. Bit stream timer 130 includes a monostable multivibrator 131 receiving the DATA signal through OR circuit 132. The monostable multivibrator 131 is triggered by receipt of a data bit and developes a timing signal of a time period corresponding to the duration set for a stream of data bits conforming to the preselected binary code. The timing signal is preferably a little longer than the duration of the code in order to minimize the adverse effects of any drift caused by ambient conditions. This timing signal is the signal BURST in FIG. 3A and its inverse is $\overline{\text{BURST}}$.

The $\overline{\text{BURST}}$ signal is normally logically high and the input 5 of OR circuit 132 is inverted so as to be normally held logically low. The OR circuit 132 will thus trigger the monostable multivibrator when the first data bit is received at input 4 of the OR circuit 132. Triggering of the monostable multivibrator 131 drives $\overline{\text{BURST}}$ logically low and changes the input 5 of OR circuit 132 high. This effectively blocks the OR circuit from changing during the timing signal $\overline{\text{BURST}}$ and thus no further data bits can be received by the monostable multivibrator during the timing period set for the monostable multivibrator.

Bit counter 120 includes a counter 122 receiving the data bits through OR circuit 124. Input 1 of OR circuit 124 is grounded and thus held logically low and input 2 of this OR circuit inverts the DATA signal so as to advance counter 122 after each data bit. The reset port of counter 122 receives the $\overline{\text{BURST}}$ signal. A logically high signal at the reset port of counter 122 resets the counter to zero and holds it there until a low signal is received at the reset port. The counter 122 thus functions to count data bits only during a time period corresponding to the duration set for a stream of data bits conforming to the code, and supplies a count of the data bits received during this time period.

Counter 122 uses the binary system to record the number of data bits received, and the output pins 3, 4, 5 and 6 of counter 122 conform, respectively, to the first four places of a number represented in the binary system. Thus, for the decimal numbers 1 through 8, pins 3, 4, 5 and 6 of counter 122 develop the following logic signals:

| Pin | | | |
|---|---|---|---|
| 6 | 5 | 4 | 3 |
| 0 | 0 | 0 | 1 |
| 0 | 0 | 1 | 0 |
| 0 | 0 | 1 | 1 |
| 0 | 1 | 0 | 0 |
| 0 | 1 | 0 | 1 |
| 0 | 1 | 1 | 0 |
| 0 | 1 | 1 | 1 |
| 1 | 0 | 0 | 0 |

Thus, it can be seen that a logically high signal will be present at one or more of pins 3, 4 and 5 of any count of the counter less than decimal eight, and pin 6 will be logically high only after the counter has reached decimal eight.

The BURST signal from the monostable multivibrator 131 is sent to the stream-interval time 110 which includes a monostable multivibrator 111 triggered through OR circuit 112 by the BURST signal. When triggered, the monostable multivibrator 111 develops a signal MSG for a time period corresponding to the interval between successive streams of data bits conforming to the binary code. Again, this time period is set a little longer than the interval to provide for drift of the time period due to ambient conditions. If the monostable multivibrator 111 should not receive another BURST signal within the proper time period, it times out to drive the MSG signal logically low.

Stream counter 80 includes a counter 82 advanced by pulses from OR circuit 84. Input 9 of OR circuit 84 receives the $\overline{\text{BURST}}$ signal which is normally high to prevent OR circuit 84 from changing over. When monostable multivibrator 131 is triggered, however, $\overline{\text{BURST}}$ is driven low and OR circuit 84 changes according to the status of its input 10. Input 10 of OR circuit 84 receives the inverse of signal QD taken from pin 6 of counter 122. Pin 6 of counter 122 is normally logically low and goes high only when eight data bits have been recorded by counter 122 and thus the OR circuit 84 advances the counter 82 each time eight data bits are received within the time period set for the monostable multivibrator 131. Further, counter 82 is held at zero and reset by a logically high signal at its reset port 15. Reset port 15 is connected to the output of NAND circuit 102 and thus the counter 82 is reset or held at zero whenever input 5 or 6 of NAND circuit 102 is logically low. NAND circuit 102 forms part of the defeat circuit 100 and its input 6 will be driven logically low whenever less than eight data bits are recorded in the bit counter 120 during the time period set for the monostable multivibrator 131, and input 5 will be driven logically low whenever the interval between successive streams exceeds the time period set for the monostable multivibrator 111, as will be set forth more fully below.

NAND circuit 92 forms part of the stream-valid logic 90 and has its output connected to input 6 of NAND circuit 102. Input 8 of NAND circuit 92 receives the $\overline{\text{BURST}}$ signal and is thus logically high at the end of the timing period corresponding to the duration of the streams A of the binary code. If, at this time, the counter 122 has counted less than eight data bits, one or more of pins 3, 4 and 5 of counter 122 will be logically high. Since these pins 3, 4 and 5 are connected to input 9 of NAND circuit 92, NAND cirucit 92 will be driven logically low at this occurance to make NAND circuit 102 logically high and thus reset counter 82. Consequently, counter 82 is reset anytime a stream of data bits of the prescribed time period is received having less than eight data bits.

Input 5 of NAND circuit 102 receives the signal MSG from the monostable multivibrator 111. Consequently, input 5 of NAND circuit 102 will be logically low to reset counter 82 whenever monostable multivibrator 111 times out to signify an interval between successive streams that exceeds the time period prescribed by the monostable multivibrator 111.

Further, monostable multivibrator 111 will be reset to drive MSG logically low whenever more than eight data bits are received during the time period set in monostable multivibrator 131. More particularly, NAND circuit 94 forms part of the stream-valid logic 90 and has its input 2 connected to output pin 6 of counter 122. Pin 6 goes logically high only after eight data bits have been received, and if another data bit is received during stream duration, input 1 of NAND circuit 94 also goes high to generate the signal $\overline{\text{CLEAR}}$. This $\overline{\text{CLEAR}}$ signal is directed to the reset port of monostable multivibrator 111 to terminate the high level of signal MSG and thus reset counter 82.

If counter 82 records eight valid bit streams without being reset, it generates at its output the DESTRUCT signal sent to the test jack 40. As descrived above, test jack 40 passes the DESTRUCT signal to the filter network 44 when a plug 42 is not inserted. Filter network 44 eliminates low frequency interference or noise pulses to prevent false triggering. Latch 45 is comprised of the silicon controlled rectifier (SCR) 46 which is gated by the DESTRUCT signal to power the respective drive circuits 52 and 62 through the delay circuits 72 and 74.

The sonic emitter 60 is preferably a piezo-electric device capable of emitting 85 decibels at 4000 cycles. Such devices, as well as suitable batteries for the security device are known. The batteries should be capable of lasting a full year when supplying a 6 volt supply of the proper current to the receiver unit 10. Preferably, the batteries are lithium cells recently developed.

Also, the logic components described above are preferably from the CMOS family in order to keep power requirements to a minimum. In this way, more current can be directed to the receiver unit 10 to provide it with a relatively high sensitivity to overcome any nulls or weak areas in the carrier signal field. Also, it is preferable to have as few logic components as possible in order to reduce the space requirements. To this end, particular CMOS packages containing multiple and independent components are preferred. For example, the three NAND circuits 92, 94 and 102, as well as the schmitt trigger 24 may be provided by the 4093 having four independent NAND circuits with proper hysteresis to serve as schmitt triggers. The pin connections for the 4093 package are labeled in FIG. 3A. Further, the monostable multivibrators 111 and 131 may be provided in the single CMOS package 4098 and the respective counters 82 and 122 may be provided by the CMOS package 4520 dual counter. Again, suitable pin connections are shown in FIG. 3A.

While the security device of the present invention has been described in connection with a particular embodiment, it will be apparant that the new features herein set forth may be employed in other forms while still utilizing the substance of the present invention which is defined by the appended claims.

What is claimed is:

1. A security device adapted to be secreted within a package simulating a currency pack or the like for foiling unauthorized removal of said package passed a local electromagnetic carrier signal carrying information in a predetermined binary code, said binary code including a predetermined number of streams of serial data bits, said streams each being of a predetermined duration with a predetermined number of data bits and being separated from one another by predetermined time intervals, said device comprising:

means for receiving selectively signals in the frequency range of said carrier signal;

means connected to said receiving means for detecting information carried by the received signal and producing information signals in binary form in response thereto;

logic means for receiving said information signals and producing a validation signal upon receipt of information signals conforming to said predetermined binary code; and foiling means for receiving said validation signal and activating at least one means discouraging continued removal of said package.

2. A security device according to claim 1, said foiling means including a delay circuit whereby said discouraging means will be activated a predetermined time period after production of said validation signal.

3. A security device according to claim 1 or claim 2, said binary code including eight streams of eight data bits each.

4. A security device according to claim 1 or claim 2, said logic means including a counter recording each stream of received data bits and generating said validation signal upon recording said predetermined number of correct streams, stream valid means connected to said counter for resetting it each time the stream being received fails to contain said predetermined number of data bits in a first time period corresponding to said predetermined duration, and interval-valid means connected to said counter for resetting it whenever the time period between successive streams exceeds a second time period corresponding to said predetermined interval.

5. A security device according to claim 4, said stream-valid means and said interval-valid means including a common NAND circuit having its output connected to the reset port of said counter, said stream-valid means including low count means connected to one input of said common NAND circuit for making said input logically low whenever less than said predetermined number of data bits are received during said first time period and said interval-valid means including a timer having that output thereof adapted to go logically low after expiration of said second time period connected to the other input of said NAND circuit whereby said NAND circuit will output a logically high signal to reset said counter whenever the interval between successive streams is too long, or less than said predetermined number of data bits are received during said first time period.

6. A security device according to claim 5, said interval-valid means including a high count means connected to the reset port of said timer for resetting it whenever more than said predetermined number of data bits are received during said first time period.

7. A security device according to claim 6, said high count means and said low count means including a common bit counter receiving each data bit and adapted to.be reset upon the beginning of each stream, said low count means including a NAND circuit having its output connected to said common NAND circuit with one input thereof adapted to go logically high after said first time period and the other input connected to several outputs of said bit counter, said several outputs being selected so that a logically high signal will appear in at least any one thereof for any count below said predetermined number whereby said NAND circuit will output a logical low to said common NAND circuit whenever the count of said data bits during said first time period is below said predetermined number of data bits.

8. A security device according to claim 7, said high count means including a second NAND circuit having its output connected to the reset port of said timer with one input receiving said data bits and the other input thereof connected to that output of said bit counter receiving a logically high signal after the count of said bits reaches said predetermined number of bits whereby said second NAND circuit will reset said timer whenever more than said predetermined number of said bits are received during said first time period.

9. A security device, according to claim 1 or 2 said discouraging means including a pyrotechnic device adapted to liberate tear gas upon activation.

10. A security device according to claim 9, said pyrotechic device further being adapted to liberate a staining agent.

11. A security device according to claim 9, said discouraging means further including a sonic emitter.

12. A security device according to claim 1 or 2 said means including a sonic emitter.

13. A security device according to claim 1 or 2 further including means selectable for inhibiting activation of said foiling means during production of said validation signal.

14. A security device according to claim 13, said inhibiting means including a test jack adapted to be operated by insertion of a plug, said jack being concealed beneath the currency band of said pack.

15. A security device according to claim 14 said plug including means responsive to said validation signal for signaling proper operation of said security device during a test.

16. A security device according to claim 2, said discouraging means including a sonic emitter and a pyrotechnic device activated after said sonic emitter.

* * * * *